US008402722B2

(12) United States Patent
Buesching

(10) Patent No.: US 8,402,722 B2
(45) Date of Patent: Mar. 26, 2013

(54) METHOD FOR MANUFACTURING A CONTAINER ASSEMBLY

(75) Inventor: Scott Michael Buesching, Howell, MI (US)

(73) Assignee: Omni Partners LLC, Wixom, MI (US)

( * ) Notice: Subject to any disclaimer, the term of this patent is extended or adjusted under 35 U.S.C. 154(b) by 525 days.

(21) Appl. No.: 12/607,511

(22) Filed: Oct. 28, 2009

(65) Prior Publication Data

US 2011/0097453 A1 Apr. 28, 2011

(51) Int. Cl.
*B65B 61/00* (2006.01)
*B65D 81/32* (2006.01)

(52) U.S. Cl. ..... 53/420; 53/467; 53/474; 206/217; 206/534; 206/232

(58) Field of Classification Search ..... 53/420, 53/467, 474; 206/217, 534, 232
See application file for complete search history.

(56) References Cited

U.S. PATENT DOCUMENTS

| | | | | | |
|---|---|---|---|---|---|
| 378,752 | A * | 2/1888 | Ader | 215/6 |
| 896,903 | A * | 8/1908 | Ferry | 206/217 |
| 2,328,872 | A * | 9/1943 | Yealdhall et al. | 206/217 |
| 2,374,092 | A * | 4/1945 | Glaser | 215/6 |
| 2,766,796 | A * | 10/1956 | Tupper | 220/521 |
| 3,288,344 | A * | 11/1966 | Woollen et al. | 229/103.1 |
| 3,642,499 | A * | 2/1972 | Castell | 426/383 |
| 4,416,370 | A * | 11/1983 | Beall | 206/217 |
| 4,795,028 | A * | 1/1989 | Wittig et al. | 206/217 |
| 4,984,723 | A * | 1/1991 | Hsu | 224/148.4 |
| 5,165,546 | A * | 11/1992 | Jaeger et al. | 206/534 |
| 5,366,089 | A * | 11/1994 | Parker | 206/546 |
| 5,531,353 | A * | 7/1996 | Ward et al. | 220/729 |
| 5,647,481 | A * | 7/1997 | Hundertmark et al. | 206/219 |
| 5,664,671 | A * | 9/1997 | Nedblake, Jr. | 206/217 |
| 5,722,558 | A * | 3/1998 | Thompson | 220/521 |
| 6,382,411 | B1 | 5/2002 | Wentling | |
| 6,386,367 | B1 | 5/2002 | Bayliss, IV | |
| 6,398,071 | B1 * | 6/2002 | Fellers | 221/174 |
| 6,405,675 | B1 * | 6/2002 | Mills | 119/74 |
| 6,681,958 | B2 | 1/2004 | Sorenson et al. | |
| 7,063,229 | B2 * | 6/2006 | Westerhof et al. | 220/506 |
| 7,066,322 | B2 * | 6/2006 | Wilson | 206/217 |
| 7,097,069 | B2 * | 8/2006 | Cavanagh | 221/312 R |
| 7,328,788 | B2 * | 2/2008 | Mahieu et al. | 206/5.1 |
| 7,946,422 | B1 * | 5/2011 | Bjerke | 206/546 |
| 8,172,103 | B2 * | 5/2012 | Spyros et al. | 220/23.86 |
| 2001/0030191 | A1 * | 10/2001 | Bopp et al. | 220/23.4 |
| 2002/0121454 | A1 | 9/2002 | Ross | |
| 2004/0065565 | A1 * | 4/2004 | Buesching et al. | 206/217 |
| 2004/0262173 | A1 * | 12/2004 | Buesching et al. | 206/217 |
| 2005/0051549 | A1 * | 3/2005 | Nelson | 220/23.83 |
| 2005/0067414 | A1 * | 3/2005 | Lipson | 220/23.86 |

(Continued)

*Primary Examiner* — Hemant M Desai
(74) *Attorney, Agent, or Firm* — Reising Ethington P.C.

(57) ABSTRACT

A container assembly stores a potable liquid and is adapted for storing a second consumable. The container assembly includes a primary container adapted for storing the potable liquid therein. The primary container includes a container top, a container bottom, and a container side. The container assembly also includes a cup defining a cup bottom, a cup side extending up from the cup bottom, and a cup lip removably engagable with the container side to seal the cup prior to use. The cup stores the second consumable between the cup side and the container side. The cup side defines a radius of curvature longitudinally from the cup bottom up toward the cup lip such that the cup side magnifies the second consumable stored therewithin as viewed from outside the cup.

7 Claims, 4 Drawing Sheets

U.S. PATENT DOCUMENTS

2007/0278122 A1* 12/2007 McCumber et al. ..... 206/514
2008/0223817 A1 9/2008 Song
2009/0114615 A1 5/2009 Joubert et al.
2010/0163507 A1* 7/2010 Morgan ..... 215/6
2011/0198355 A1* 8/2011 Mullen ..... 220/521

* cited by examiner

METHOD FOR MANUFACTURING A CONTAINER ASSEMBLY

BACKGROUND ART

1. Field of the Invention

The invention relates to a container assembly for storing a potable liquid. More particularly, the invention relates to a container assembly for storing a potable liquid and a second consumable separate from the potable liquid.

2. Description of the Related Art

There are many instances when a person desires or is in need of a drink of water or some other type of beverage. Often times, it is also a desire of the person looking for a drink to want to consume another product at the same time. These products include, but are not limited to, aspirin, ibuprofen, acetaminophen, non-steroidal anti-inflammatory drugs, protein supplements, probiotics, salt tablets, and the like. At times, it is difficult to locate the proper product or the appropriate drink. In addition, there are several times where a person only desires a single dosage or serving of the other product and does not need or want to purchase a larger container of the product, e.g. a bottle of aspirin. This is often the case when someone is attending an event and requires only a single dosage and does not want to have to carry or properly store the remaining product.

In other instances, a person may have trouble drinking from a bottle, especially if the person is feeling ill. A cup is easier to drink from than a bottle.

And finally, a bottle is difficult storage device with which someone can share the drink with another. Having a secondary container facilitates the sharing of the liquid with another without the risk of passing anything between the two people that may cause an illness or infection in one or the other.

SUMMARY OF THE INVENTION

A container assembly stores a potable liquid and is adapted for storing a second consumable. The container assembly includes a primary container adapted for storing the potable liquid therein. The primary container includes a container top, a container bottom, and a container side. The container assembly also includes a cup defining a cup bottom, a cup side extending up from the cup bottom, and a cup lip removably engagable with the container side to seal the cup prior to use. The cup stores the second consumable between the cup side and the container side. The cup side defines a radius of curvature longitudinally from the cup bottom up toward the cup lip such that the cup side magnifies the second consumable stored therewithin as viewed from outside the cup.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
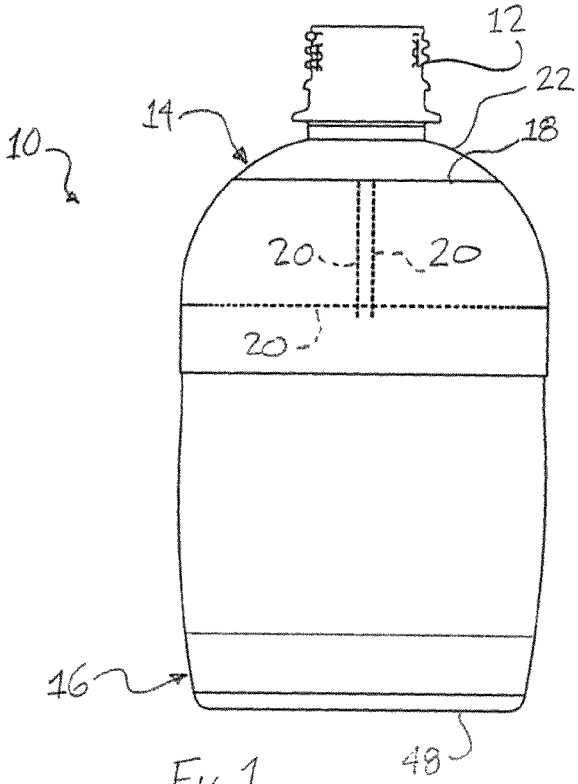
FIG. 1 is a side view of one embodiment of the invention.

Referring to FIG. 1, one embodiment of the container assembly is generally indicated at 10. The profile of the container assembly 10 is similar to that of a traditional bottle used to retain a potable liquid such as water, soda, sports drink, vitamin drink and the like. The container assembly 10 includes a threaded opening 12 where the potable liquid is poured in and out thereof. A cap (not shown) is used to seal the threaded opening 12. It should be appreciated by those skilled in the art that the threaded opening 12 could be replaced with a pull top or some other type of resealable opening allowing the person using the container assembly 10 to reseal the container assembly 10 as desired.

The container assembly includes a primary container, generally shown at 14, and a cup, generally shown at 16. Disposed over a portion of the primary container 14 and a portion of the cup 16 is a shrink wrap cover 18. This shrink wrap cover 18 helps seal the cup 16 to the primary container 14 and allows the manufacturers of the container assembly 10 the potable drink, or any other third party to identify and market this product. The shrink wrap cover 18 is designed to include perforations 20 to assist in the removal of the shrink wrap cover 18.

Figure 2:
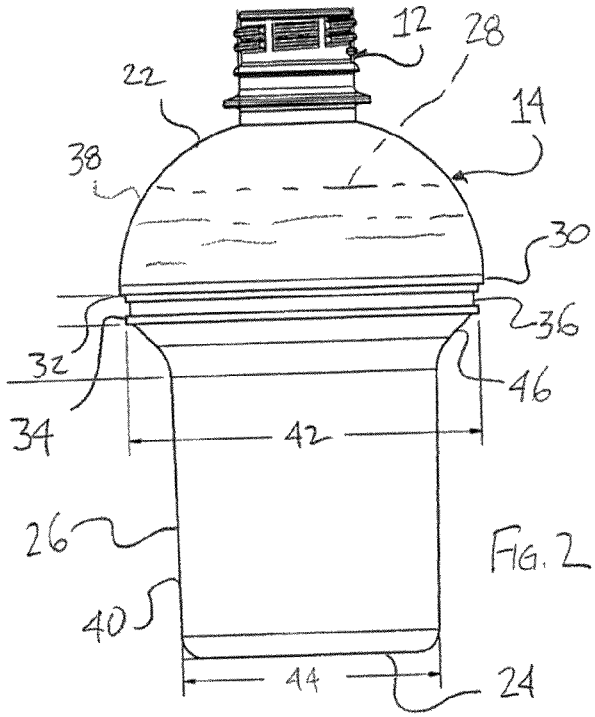
FIG. 2 is a side view of one embodiment of a primary container incorporated into the invention.

Referring to FIG. 2, a side view of the primary container 14 is shown. The primary container includes a container top 22, a container bottom 24 and a container side 26. In the embodiment shown, the primary container 14 has a circular cross section. As such, there is only a single container side 26. Designs of the primary container 14 may includes cross sections other than a circle and may include more than one container side 26. The primary container 14 defines an interior into which the portable liquid 28 is stored. There is only a single opening in the primary container 14 and that is the threaded opening 12 of the container assembly 10.

The container top 22 of the primary container 14 includes a seating surface 30. The seating surface 30 will receive the cup 16 and will be discussed in greater detail subsequently. Between the container top 22 and the container side 26 are a pair of ring flanges 32, 34. These ring flanges 32, 34 define a peripheral channel 36. The ring flanges 32, 34 and the peripheral channel 36 are used for structural support between the container top 22 and the container side 26. The ring flanges 32, 34 provide the necessary rigidity for the proper seating and sealing between the primary container 14 and the cup 16.

The peripheral channel 36 defines a cross-sectional plane above which the primary container 14 includes an upper portion 38 and below which is a lower portion 40. While the interior of the primary container 14 is a singular space, the upper portion 38 and lower portion 40 are visually different in that the upper portion 38 defines an upper diameter 42 and the lower portion 40 defines a lower diameter 44 such that each of the upper 42 and lower 44 diameters differ from one another. In particular, the lower diameter 44 is less than the upper diameter 42. This allows the lower portion 40 of the primary container 14 to be covered by a cup 16. In the embodiment shown in FIG. 2, a chamfered neck 46 extends between the lower ring flange 34 and a portion of the container side 26 that defines the lower diameter 44. As discussed herein, the chamfered neck 46 is a part of the container side 26, although they may be different structurally in other embodiments.

Figure 3:
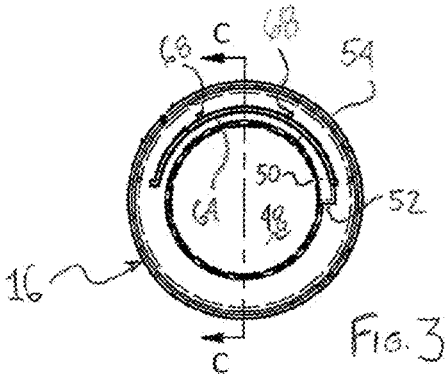
FIG. 3 is a top view of the cup used in the invention.
Figure 4:
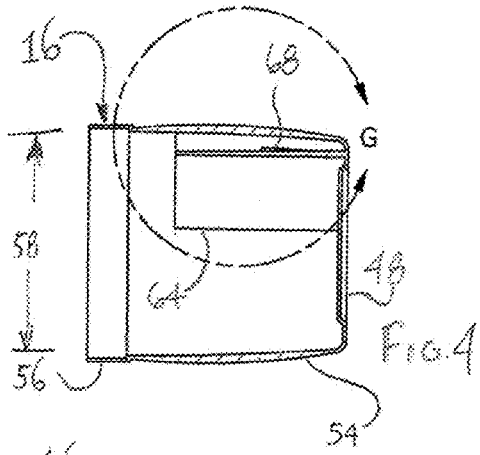
FIG. 4 is a cross-sectional side view taken along lines C-C of FIG. 3.
Figure 5:
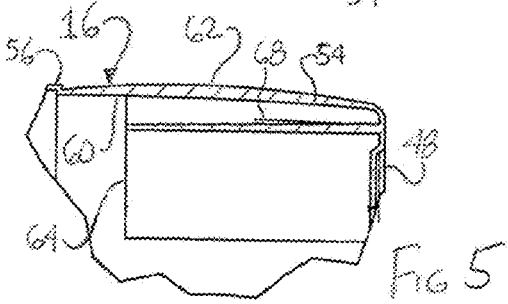
FIG. 5 is a partially cutaway enlargement of area G of FIG. 4.

Referring to FIGS. 3 through 5, the cup 16 is shown in greater detail. The cup 16 defines a cup bottom 48. The cup bottom 48 may be flat or, as shown in the Figures, may have indentations formed therein to facilitate the manufacture and packaging thereof. As may be seen in FIG. 3, the cup bottom 48 includes an indentation commonly referred to as a registration slug 50 defining a positioning wall 52 that allows the automation of the manufacture of the cup 16 and the container assembly 10 by knowing the exact orientation of the container assembly 10 so that the cup 16 designs, shrink wrap and second consumables 66 (discussed subsequently) are properly orientated during assembly.

The cup 16 also includes a cup side 54 that extends from the cup bottom 48 up to a lip 56. The lip 56 is designed to engage and seat on the seating surface 30 of the primary container 14. The lip 56 is designed to ensure the cup 16 is secured to the primary container 14 and provides strength to the cup side 54 such that the cup side 54 will not readily collapse during the use of the cup 16 and/or the primary container 14. The cup 16 defines a cup diameter 58 which is greater than the lower diameter 44 of the primary container 14 allowing the lower portion 40 of the primary container 14 to be inserted into the cup 16. As shown in the Figures, the cup diameter 58 approximates the upper diameter of the upper portion 38 such that the lip 56 will frictionally fit onto the seating surface 30 creating a seal between the cup 16 and the primary container 14.

The cup side 54 includes an interior cup surface 60 and an exterior cup surface 62. The radii of curvature for each of the interior 60 and exterior 62 cup surfaces differ from one another. As shown in the Figures, the interior cup surface 60 has a radius of curvature that approaches infinity, i.e. it is flat, whereas the exterior cup surface 62 has a finite radius of curvature. As such, the exterior cup surface 62 extends through a curved plane with reference to its longitudinal orientation. More specifically, the exterior cup surface 62 is defined by two radii of curvature: the first being the cross-sectional radius of the cup 16 itself and the second oriented perpendicular to the first radius of curvature defining a second radius of curvature that extends longitudinally between the cup bottom 48 and the lip 56.

It is the second radius of curvature in the exterior cup surface 62 with respect to the flat interior cup surface 60 that allows the cup side 54 to define a magnification of the contents of the cup 16. It should be appreciated by those skilled in the art that the radii of curvature of the two cup surfaces 60, 62 may differ, but the overall relationship therebetween would create a magnification. In the preferred embodiment, the magnification created by the cup side 54 is two times.

The cup 16 includes a retainer 64 that extends up from the cup bottom 48. The retainer 64 retains a second consumable 66 (best seen in FIG. 6) within the cup 16 up against the cup side 54. The retainer 64 defines a length that is shorter than the length of the cup side 54. The retainer 64 is curved similar to the cup side 54. Therefore, the retainer 64 complements the cup side 54. In the embodiment shown, the retainer 64 extends through an arc of a circle because the cup 16 is cylindrical. It should be appreciated by those skilled in the art that the retainer 64 would extend up from the cup bottom 48 in a manner similar to the shape of the cup side 54. Therefore, the retainer 64 would be flat should the cup 16 define a square or rectangular shape.

The retainer 64 includes retention flanges 68. The retention flanges 68 extend out from the retainer 64 perpendicularly thereto. The retention flanges 68 extend out therefrom toward the cup side 54. The retention flanges 68 assist in the retention of the second consumable 66 against the cup side 54.

Figure 6:
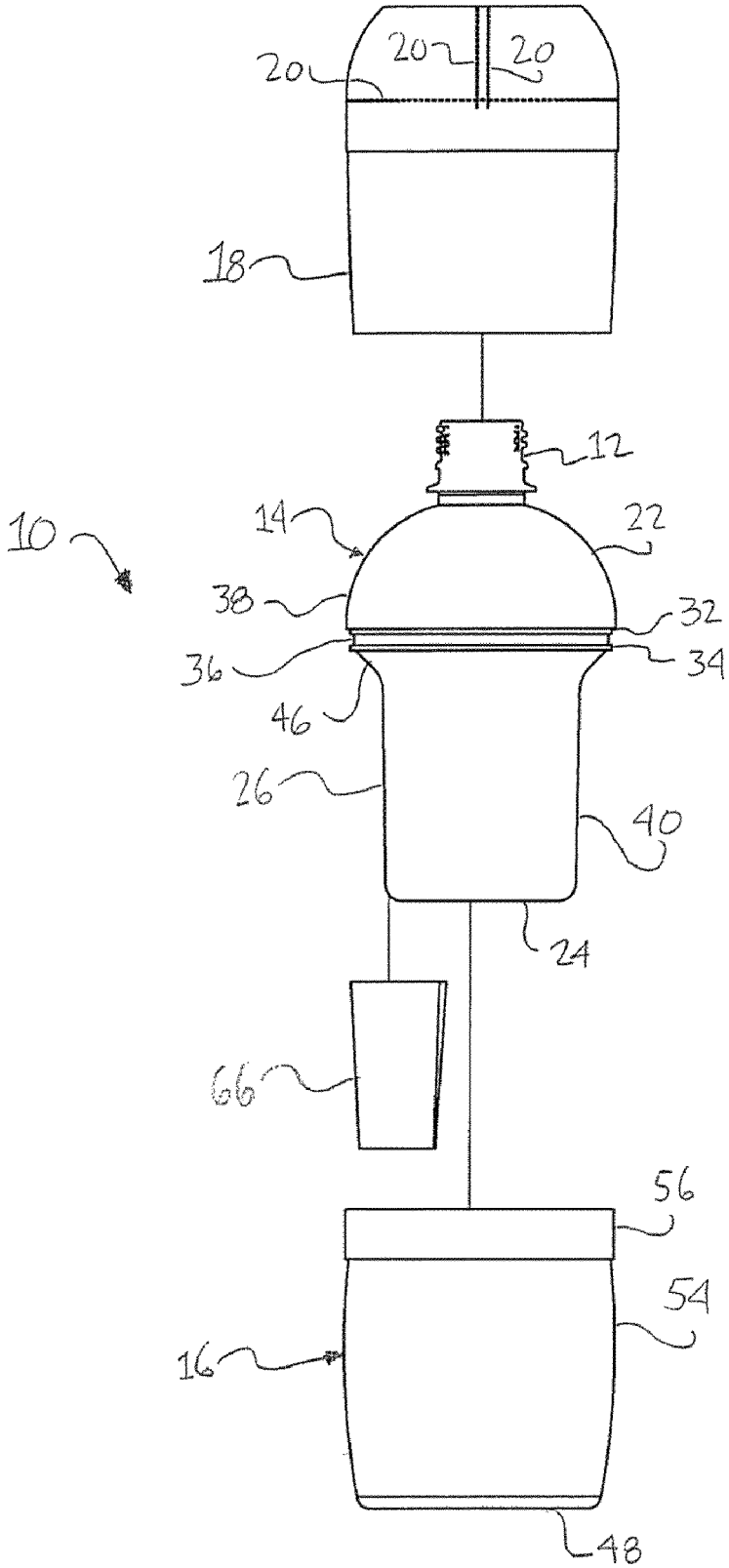
FIG. 6 is an exploded side view of one embodiment of the invention.

The second consumable 66 is shown in package form in FIG. 6. The package would be a single dosage of whatever the consumable is. For example, if the second consumable 66 is medicine, the second consumable 66 would be packaged in a form commonly referred to as a "two pack." If the second consumable 66 were a supplement, the package for the second consumable 66 would be designed to provide a single serving that is commensurate with the amount of potable liquid in the primary container 14. As such, the person using the container assembly 10 may dispose immediately of the packaging of the second consumable 66 once it is consumed or mixed with the potable liquid in the cup 16.

The method for manufacturing the container assembly 10 includes the step of filling the primary container 14 with a potable liquid through the threaded opening 12. The primary container 14 is then sealed. The second consumable 66 is inserted into the cup 16. The second consumable 16 is positioned between the cup side 54 and the retainer 66. In one embodiment, the insertion of the second consumable 66 into the cup 16 includes blowing the second consumable 66 therein.

Once the second consumable 66 is positioned within the cup 16 adjacent the retainer 64, the cup 16 is secured to the primary container 14 such that the second consumable 66 is disposed between the primary container 14 and, more specifically, the container side 26, and the cup 16. By having the second consumable 66 disposed between the container side 26 and the cup side 54 (with the assistance of the retainer 64), the second consumable 66 is readily viewable and identifiable for purposes of selection, purchase and, eventually, consumption by having the second consumable adjacent the cup side 54 and magnified making its ability to be viewed even greater.

Figure 7:
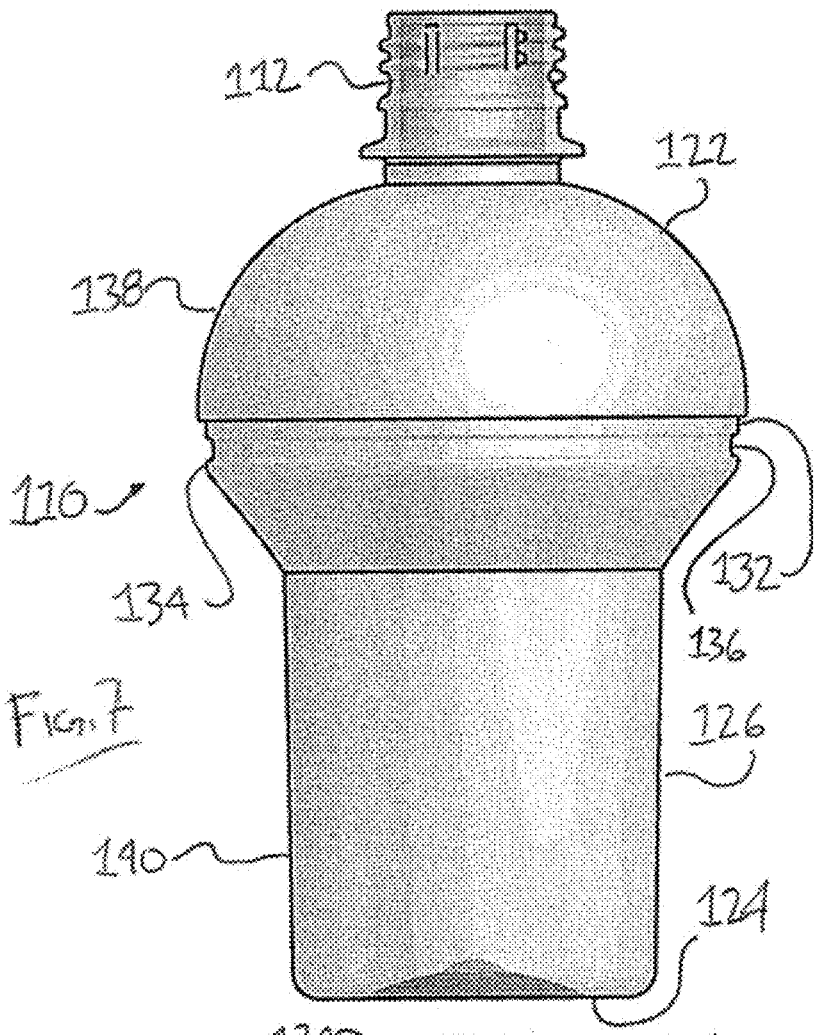
FIG. 7 is a side view of an alternative embodiment of the invention.
Figure 8:
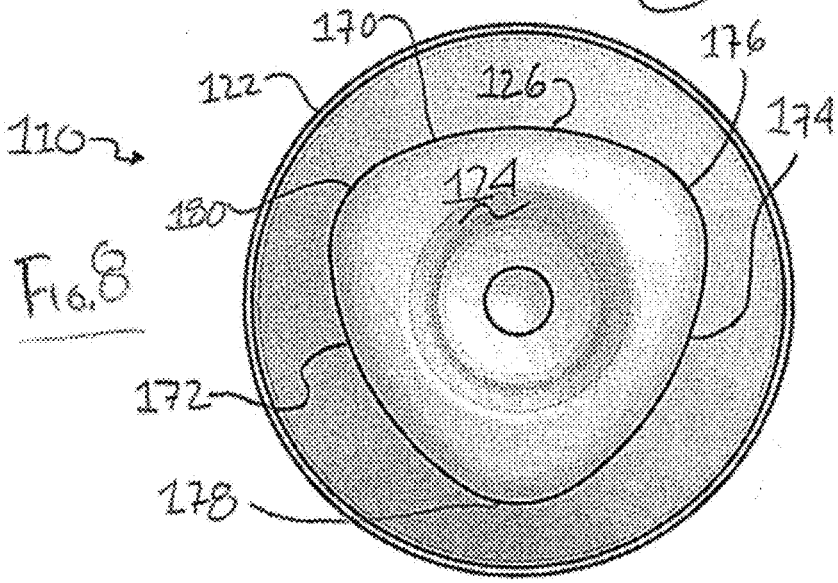
FIG. 8 is a bottom view of the alternative embodiment shown in FIG. 7.

Referring to FIGS. 7 and 8, an alternative embodiment is shown wherein like elements are shown offset by 110. This embodiment is shown to illustrate how the lower portion 140 of the primary container 114 defines a cross-sectional shape other than a circle, as is shown in the preferred embodiment. In the alternative embodiment, the cross-sectional shape defined by the lower portion 140 is that of a triangle having three sides 170, 172, 174 with rounded corners 176, 178, 180. It should be appreciated that upper portion 138, the lower portion 140 and the cup (not shown in FIGS. 7 and 8) may extend through any cross-sectional area without deviating from the invention disclosed herein.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. A method for manufacturing a container assembly having a primary container and a cup, the cup including a cup side defining a radius of curvature as measured longitudinally such that the cup side magnifies, the method comprising the steps of:

filling the primary container with a potable liquid;

inserting a second consumable into the cup; and securing the cup with the primary container such that the second consumable is disposed between the primary container and the cup in a manner that the second consumable is magnified by the cup side.

2. A method as set forth in claim 1 including the step of wrapping the container assembly with a plastic cover after the cup is secured to the primary container.

3. A method as set forth in claim 2 wherein the step of inserting includes blowing the second consumable into the cup.

4. A method as set forth in claim 3 including the step of retaining the second consumable in place prior to securing the cup to the primary container.

5. A method for manufacturing a container assembly having a primary container and a cup with the cup defining a cup side, a cup bottom and a retainer extending up from the cup bottom, the method comprising the steps of:

filling the primary container with a potable liquid;

inserting a second consumable into the cup between the cup side and the retainer; and securing the cup with the primary container such that the second consumable is disposed between the primary container and the cup.

6. A method as set forth in claim 5 including the step of wrapping the container assembly with a plastic cover after the cup is secured to the primary container.

7. A method as set forth in claim 6 wherein the step of inserting includes blowing the second consumable into the cup.

* * * * *